US010476151B2

(12) United States Patent
Seo et al.

(10) Patent No.: US 10,476,151 B2
(45) Date of Patent: Nov. 12, 2019

(54) ANTENNA APPARATUS AND ELECTRONIC DEVICE HAVING THE SAME

(71) Applicant: Samsung Electronics Co., Ltd., Suwon-si, Gyeonggi-do (KR)

(72) Inventors: Jaemin Seo, Suwon-si (KR); Suyang Park, Hwaseong-si (KR); Jaesun Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1007 days.

(21) Appl. No.: 14/282,551

(22) Filed: May 20, 2014

(65) Prior Publication Data

US 2014/0347242 A1 Nov. 27, 2014

(30) Foreign Application Priority Data

May 27, 2013 (KR) ..... 10-2013-0059565

(51) Int. Cl.
*H01Q 1/48* (2006.01)
*H01Q 1/24* (2006.01)
*H01Q 1/52* (2006.01)

(52) U.S. Cl.
CPC ..... *H01Q 1/48* (2013.01); *H01Q 1/243* (2013.01); *H01Q 1/521* (2013.01)

(58) Field of Classification Search
CPC .. H01Q 1/48; H01Q 9/40; H01Q 1/12; H01Q 1/243
USPC ..... 343/848, 702, 878
See application file for complete search history.

(56) References Cited

U.S. PATENT DOCUMENTS

2008/0204340 A1 8/2008 Kim et al.
2010/0238072 A1 9/2010 Ayatollahi et al.
2011/0057852 A1* 3/2011 Holland ..... H01Q 9/28 343/795
2012/0032865 A1* 2/2012 Toyao ..... H01P 1/2005 343/835
2012/0319919 A1* 12/2012 Kirovski ..... H01Q 1/243 343/853
2013/0120201 A1 5/2013 Park et al.
(Continued)

FOREIGN PATENT DOCUMENTS

CN 102884680 A 1/2013
JP 2012-39465 A 2/2012
JP 2012-109809 A 6/2012
(Continued)

OTHER PUBLICATIONS

Korean Office Action dated Jan. 28, 2019, issued in Korean Patent Application No. 10-2013-0059565.

*Primary Examiner* — Dameon E Levi
*Assistant Examiner* — Collin Dawkins
(74) *Attorney, Agent, or Firm* — Jefferson IP Law, LLP

(57) ABSTRACT

An antenna apparatus that is able to improve isolation between antennas that are arranged adjacent to each other and an electronic device having the same are provided. The antenna apparatus includes a plurality of antennas, and a printed circuit board connected to the plurality of antennas, wherein the printed circuit board comprises a plurality of feeding units respectively connected to the plurality of antennas and a plurality of ground units respectively connected to the plurality of antennas, and each of the ground units is separated from the other ground units by means of at least one slot.

21 Claims, 6 Drawing Sheets

(56) References Cited

U.S. PATENT DOCUMENTS

| | | | | |
|---|---|---|---|---|
| 2013/0135154 | A1 | 5/2013 | Sumi | |
| 2015/0084827 | A1* | 3/2015 | Hay | H01Q 9/0457 343/860 |

FOREIGN PATENT DOCUMENTS

| | | | |
|---|---|---|---|
| KR | 10-2008-0085362 | A | 9/2008 |
| KR | 10-0856310 | B1 | 9/2008 |
| KR | 10-2011-0109496 | A | 10/2011 |
| KR | 10-1101856 | B1 | 1/2012 |
| KR | 10-2013-0052988 | A | 5/2013 |

* cited by examiner

ANTENNA APPARATUS AND ELECTRONIC DEVICE HAVING THE SAME

CROSS-REFERENCE TO RELATED APPLICATION(S)

This application claims the benefit under 35 U.S.C. § 119(a) of Korean patent application filed on May 27, 2013 in the Korean Intellecutal Property Office and assigned Serial No. 10-2013-0059565, the entire disclosure of which is hereby incorporated by reference.

TECHNICAL FIELD

The present disclosure relates to an antenna apparatus and an electronic device having the same. More particularly, the present disclosure relates to an antenna apparatus and an electronic device having the same, which can improve isolation between antennas arranged adjacent to each other.

BACKGROUND

Based on significant advances in information, communication, and semiconductor technologies, the use of portable terminals has rapidly increased such that portable terminals have become necessities to modern people. That is, a portable device now provides advanced and diverse functions that are required by a user. For instance, the portable terminal provides various functions such as a mobile communication function, a near distance wireless communication function, a broadcast reception function, an interne access function, and the like. To this end, the portable terminal may be provided with a plurality of antennas. For instance, the portable terminal may include a mobile communication antenna, a near distance wireless communication antenna, a broadcast reception antenna, and the like.

Antennas are devices for transmitting and receiving wireless signals. As such, when the antennas are located adjacent to each other, a mutual coupling phenomenon may occur, which causes a decrease in the radiation capacity of the portable terminal. Furthermore, there may be an increase in the radiation capacity reduction when adjacently located antennas have similar operation frequency bands. In order to reduce the decrease in the radiation capacity, a portable terminal of the related art has antennas spaced more than a predetermined distance apart from each other. For instance, a portable terminal of the related has a first antenna disposed at an upper end and a second antenna disposed at a lower end. However, the need to adequately space the antennas conflicts with the desire for a portable terminal to become compact and slim. Also, recent portable terminals are provided with many electronic parts in order to provide various functions. Accordingly, there arises a problem for a portable terminal in that it is difficult to arrange antennas while establishing a sufficient space between them. Hence, there exists a need to secure isolation between adjacent antennas.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna apparatus that is able to secure isolation between adjacent antennas to thereby improve radiation capacity and an electronic device having the same.

In accordance with an aspect of the present disclosure, an antenna apparatus is provided. The antenna apparatus includes a plurality of antennas, and a printed circuit board connected to the plurality of antennas, wherein the printed circuit board comprises a plurality of feeding units respectively connected to the plurality of antennas and a plurality of ground units respectively connected to the plurality of antennas, and wherein each of the ground units is separated from the other ground units by means of at least one slot.

In accordance with another aspect of the present disclosure, an electronic device is provided. The electronic device includes a plurality of antennas, a plurality of feeding units formed on a printed circuit board and respectively connected to the plurality of antennas, and a plurality of ground units formed on the printed circuit board and respectively connected to the plurality of antennas, wherein each of the ground units is separated from the other ground units by means of at least one slot.

In accordance with another aspect of the present disclosure, an electronic device is provided. The electronic device includes a plurality of antennas located adjacent to each other, a plurality of feeding units, each of which is connected to the plurality of antennas and is formed on a printed circuit board, a plurality of ground units, each of which is connected to the plurality of antennas, and at least one capacitor which electrically connects the plurality of ground units, wherein the plurality of ground units are formed by separating a ground unit of the printed circuit board by means of at least one slot.

As described above, the antenna apparatus and the electronic device having the same according to various embodiments of the present disclosure can improve isolation between antennas located adjacently to each other. Hence, an electronic device according to the present disclosure can enhance radiation capacity.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
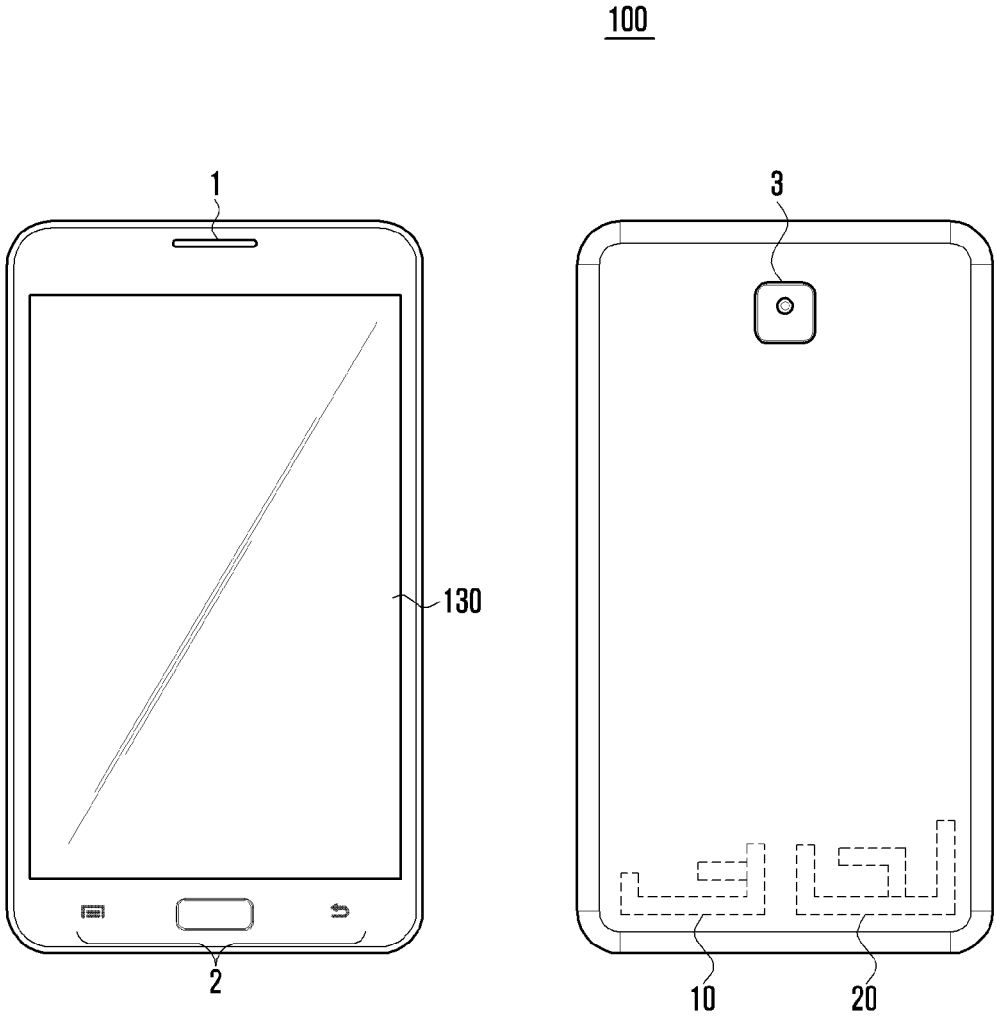
FIG. 1 is a view showing an outer shape of an electronic device having an antenna apparatus according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions about well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Particular embodiments of the present disclosure disclosed in the specification and drawings are intended to explain technical contents of the present disclosure and to assist in an understanding of the present disclosure. They are not intended to limit the scope of the present disclosure. Also, it should be apparent to those skilled in the art that other modified examples in addition to those embodiments disclosed herein can be made based on the technical idea of the present disclosure without departing from the scope of the present disclosure.

Prior to a detailed description, it should be noted of that an electronic device according to an embodiment of the present disclosure is described below as a terminal with a plurality of antennas. It should be understood that the terminal may be a mobile communication terminal, a smart phone, a tablet Personnel Computer (PC), a Personal Digital Assistant (PDA), and the like.

Various embodiments of the present disclosure explained herein below can improve isolation between a plurality of antennas arranged adjacent to each other in an electronic device, by forming a slot so that each antenna is provided with separate ground units of an island type, and by connecting the separate ground units with a lump element. Hereinafter, various embodiments of the present disclosure will be explained by way of examples of having two antennas to make explanations easy. However, it is to be understood that the present disclosure is not so limited but is equally applicable to an electronic device having three or more antennas.

FIG. 1 is a view showing an outer shape of an electronic device having an antenna apparatus according to an embodiment of the present disclosure.

Referring to FIG. 1, an electronic device 100 may include a touch screen 130 at a front surface thereof, a speaker 1 located at an upper end of the touch screen 130, and a plurality of keys 2 located at a lower end of the touch screen 130. For instance, the plurality of keys 2 may include a menu key, a home key, a cancel key, and the like. Each of the plurality of keys 2 may be formed as a button type physical key or a touch key. Meanwhile, the electronic device 100 may be provided with a camera 3 located at an upper end of a rear surface thereof, and a first antenna 10 and a second antenna 20 located at a lower end of the rear surface. For example, the electronic device 100 may be provided with a first antenna 10 and a second antenna 20 arranged adjacent to each other. For instance, the first antenna 10 and the second antenna 20 may be arranged adjacent to the lower end of the rear surface of the electronic device 100. However, the present disclosure is not limited to the construction described above, and the first antenna 10 and the second antenna 20 can be provided at a left side or a right side of the upper end of the electronic device 100.

The first antenna 10 and the second antenna 20 may be a Multiple Input Multiple Output (MIMO) antenna. Also, the first antenna 10 may be an antenna which operates at a frequency band for mobile communication using a second generation, third generation, or fourth generation (2G/3G/4G) cellular technology, and the second antenna 20 may be an antenna which operates at a connectivity frequency band for Bluetooth communication, Global Positioning System (GPS) communication, or Wi-Fi communication. The first antenna 10 and the second antenna 20 may operate at similar frequency bands.

The first antenna 10 and the second antenna 20 may be connected to a printed circuit board (not shown). The printed circuit board can include a first feeding unit (not shown) for supplying a power signal to the first antenna 10, a second feeding unit (not shown) for supplying a power signal to the second antenna 20, a first ground unit (not shown) connected to the first antenna 10 and a second ground unit (not shown) connected to the second antenna 20. The first ground unit and the second ground unit can be electrically separated from each other by means of a slot. Also, the first ground unit and the second ground unit can be connected to each other by a lump element. The lump element can be at least one of a capacitor, an inductor, and a resistor.

The ground units of the first antenna 10 and the second antenna 20 are electrically separated. Hence, the electronic device 100 can improve an isolation property between the first antenna 10 and the second antenna 20. Also, embodiments of the present disclosure can adjust isolation between the first antenna 10 and the second antenna 20 by changing a slot interval between the first ground unit and the second ground unit or a value of the lump element interconnecting the first ground unit and the second ground unit. Thus, the electronic device 100 is able to improve a radiation property in comparison with an electronic device of the related art in which a plurality of adjacent antennas use a common ground unit.

Figure 2:
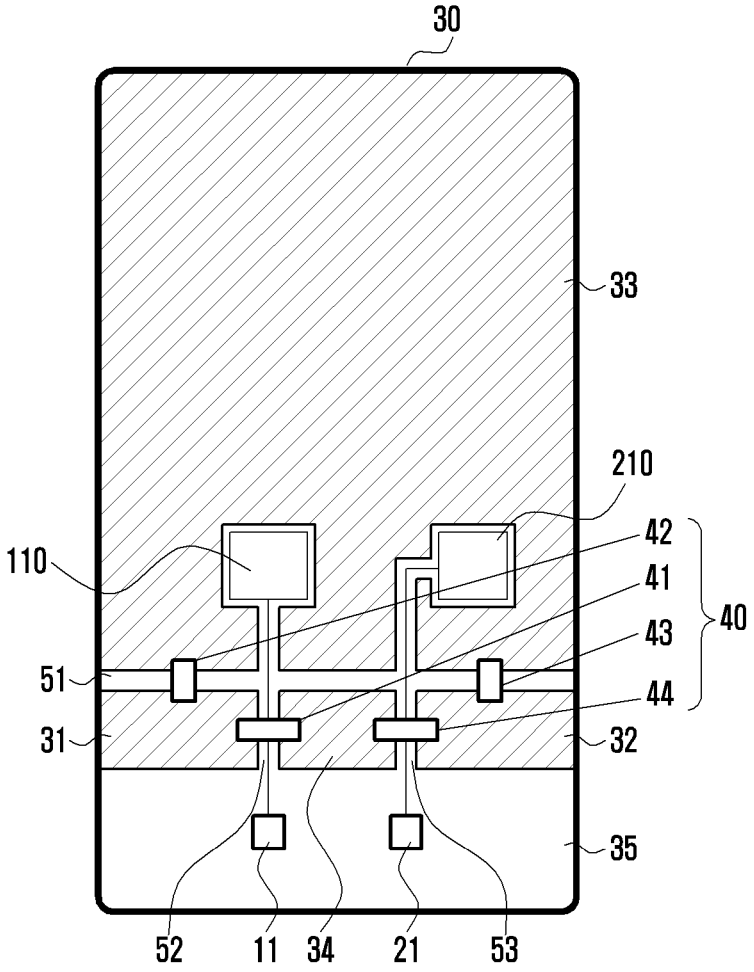
FIG. 2 is a view schematically showing a printed circuit board of an antenna apparatus according to a first embodiment of the present disclosure.

FIG. 2 is a view schematically showing a printed circuit board of an antenna apparatus according to a first embodiment of the present disclosure.

Referring to FIG. 2, a printed circuit board 30 of an antenna apparatus may include a first feeding unit 11 and a second feeding unit 21 for supplying feeding signals to a first antenna and a second antenna, respectively. The first feeding unit 11 and the second feeding unit 21 can be located at a pill-cut region 35 of the printed circuit board 30, as shown in FIG. 2.

The first feeding unit 11 and the second feeding unit 21 can be connected to a first communication module 110 and a second communication module 210, respectively. Here, the first communication module 110 may be a mobile communication module for performing a mobile communication service, and the second communication module 210 may be at least one of a Bluetooth communication module, a wireless LAN communication module, a GPS module, and the like. However, the present disclosure is not limited thereto.

The printed circuit board 30 is formed with a plurality of slots 51, 52, and 53. The plurality of slots 51, 52, 53 can separate the ground unit of the printed circuit board 30 into several sub-ground units 31, 32, and 34 and a main ground unit 33. In this regard, the first sub-ground unit 31 can be connected to the first antenna 10, and the second sub-ground unit 32 can be connected to the second antenna 20. The first sub-ground unit 31 and the second sub-ground unit 32 may be electrically separated. Thus, the first embodiment of the present disclosure can improve isolation between a first antenna and a second antenna by electrically separating the first sub-ground unit 31 and the second sub-ground unit 32.

The ground units 31, 32, 33, and 34 separated by the plurality of slots 51, 52, and 53 can be electrically connected by means of the plurality of lump elements 40 (i.e., lump elements 41, 42, 43, and 44). For instance, the first sub-ground unit 31 can be connected to the third sub-ground unit 34 through the first lump element 41, and to the main ground unit 33 through the second lump element 42. Also, the second sub-ground unit 32 can be connected to the main ground unit 33 through the third lump element 43 and connected to the third ground unit 34 through the fourth lump element 44. In this instance, the lump elements 41, 42, 43, and 44 can be capacitors. However, the present disclosure is not limited thereto, and the lump elements can be inductors, resistors, and the like.

As described above, the first embodiment of the present disclosure can prevent a decrease in the radiation capacity produced from the reduction of the ground area of a first antenna and a second antenna due to the electrical connection between the ground units 31, 32, 33, and 34 through the lump elements. Meanwhile, the first embodiment of the present disclosure can adjust values of the lump elements 41, 42, 43, and 44 to thereby optimize the radiation capacity and isolation between the first antenna and the second antenna.

While the printed circuit board 30 shown in FIG. 2 includes the first communication module 110 and the second communication module 210, this is merely for the sake of explanations. The printed circuit board may further include various electronic parts for operating the electronic device 100, such as an application processor, a camera module, a memory, an audio processor, and the like.

Figure 3:
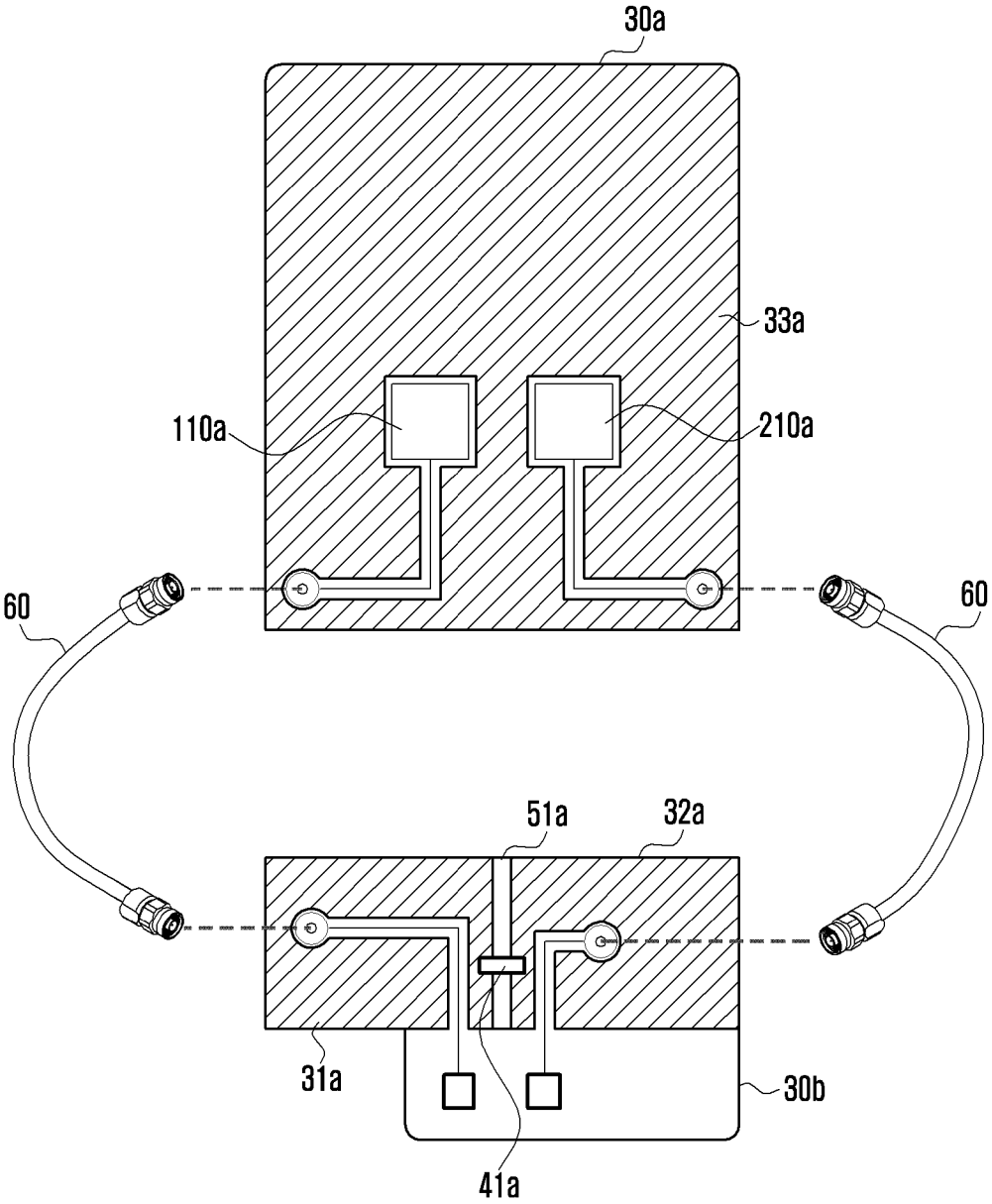
FIG. 3 is a view schematically showing a printed circuit board of an antenna apparatus according to a second embodiment of the present disclosure.

FIG. 3 is a view schematically showing a printed circuit board of an antenna apparatus according to a second embodiment of the present disclosure.

Referring to FIG. 3, the printed circuit board may include a first substrate 30*a* and a second substrate 30*b*. The first substrate 30*a* can be a main substrate, which has a main ground unit 33*a* and is provided with a first communication unit 110*a* and a second communication unit 210*a*. The second substrate 30*b* can be an auxiliary substrate, which is connected to the first substrate 30*a* by means of a connector, such as coaxial cable 60, and to which a first antenna and a second antenna are connected. In the second embodiment of the present disclosure, the ground unit of the second substrate 30*b* can be separated into two parts by forming a slot 51*a* in the second substrate 30*b*, and separated ground units 31*a*, 32*a* can be connected with each other by a lump element 41*a*. Meanwhile, since the constitution and remaining elements of the second embodiment of the present disclosure is similar to that of the first embodiment, a detailed description thereof will be omitted here.

Figure 4:
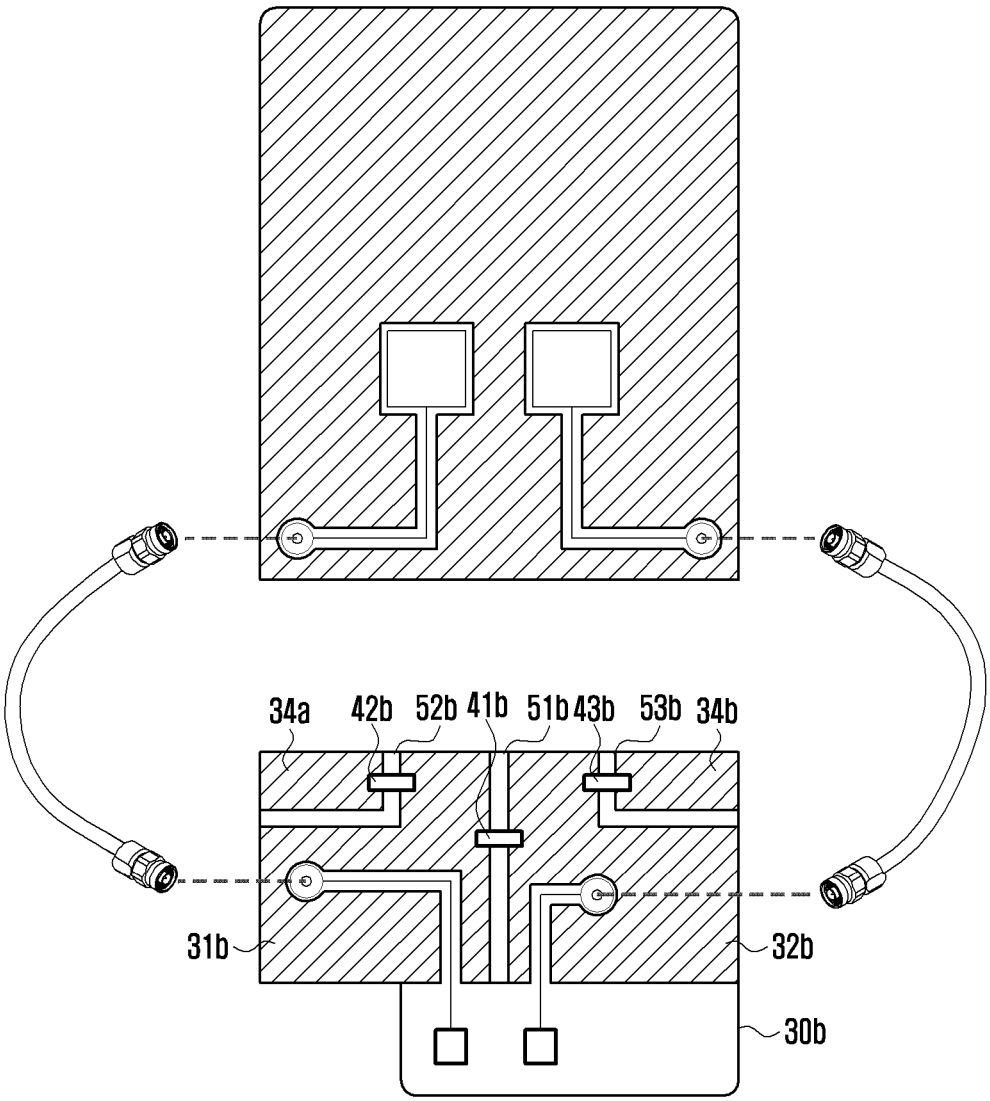
FIG. 4 is a view schematically showing a printed circuit board of an antenna apparatus according to a third embodiment of the present disclosure.

FIG. 4 is a view schematically showing a printed circuit board of an antenna apparatus according to a third embodiment of the present disclosure.

Referring to FIG. 4, the third embodiment of the present disclosure is similar to the second embodiment. However, the second substrate 30*b* may further include a second slot 52*b* and a third slot 53*b*. The second slot 52*b* and the third slot 53*b* can be formed when a ground unit of the second substrate 30*b* is connected to another ground unit of the electronic device 100. In other words, the second slot 52*b* and the third slot 53*b* can be formed when the first ground unit 31*b* and the second ground unit 32*b* are not electrically separated completely by means of only the first slot 51*b*. For example, when one side of the first ground unit 31*b* and one side of the second ground unit 32*b* are connected to another ground unit of the electronic device 100, respectively, the first ground unit 31*b* and the second ground unit 32*b* can be connected electrically through the other ground unit of the electronic device 100 even when the first slot 51*b* is formed at the second substrate 30*b*.

Accordingly, in the third embodiment of the present disclosure, the second slot 52*b* can be additionally formed to electrically separate the first ground unit 31*b* from the other ground unit of the electronic device 100, and the third slot 53*b* can be further formed to electrically separate the second ground unit 32*b* from the other ground unit of the electronic device 100. Hence, the first ground unit 31*b* and the second ground unit 32*b* can be completely separated from each other electrically. In other words, the ground unit of the second substrate 30*b* can be separated into four ground units 31*b*, 32*b*, 34*a*, and 34*b*. In this instance, the first ground unit 31*b* and the second ground unit 32*b* can be connected by means of a first lump element 41*b*, the first ground unit 31*b* and the third ground unit 34*a* can be connected by means of a second lump element 42*b*, and the second ground unit 32*b* and the fourth ground unit 34*b* can be connected by means of a third lump element 43*b*. In other words, the second substrate 30*b* can include three lump elements 41*b*, 42*b*, and 43*b*. Here, the first to third lump elements 41*b*, 42*b*, and 43*b* may be formed by capacitors and may have values optimized through experiments. For instance, the first to the third capacitors 41*b* to 43*b* can have capacitances of 1.2 pF, 6.0 pF, and 7.0 pF, respectively. However, these values are merely an example and do not limit the present disclosure.

Figure 5A:
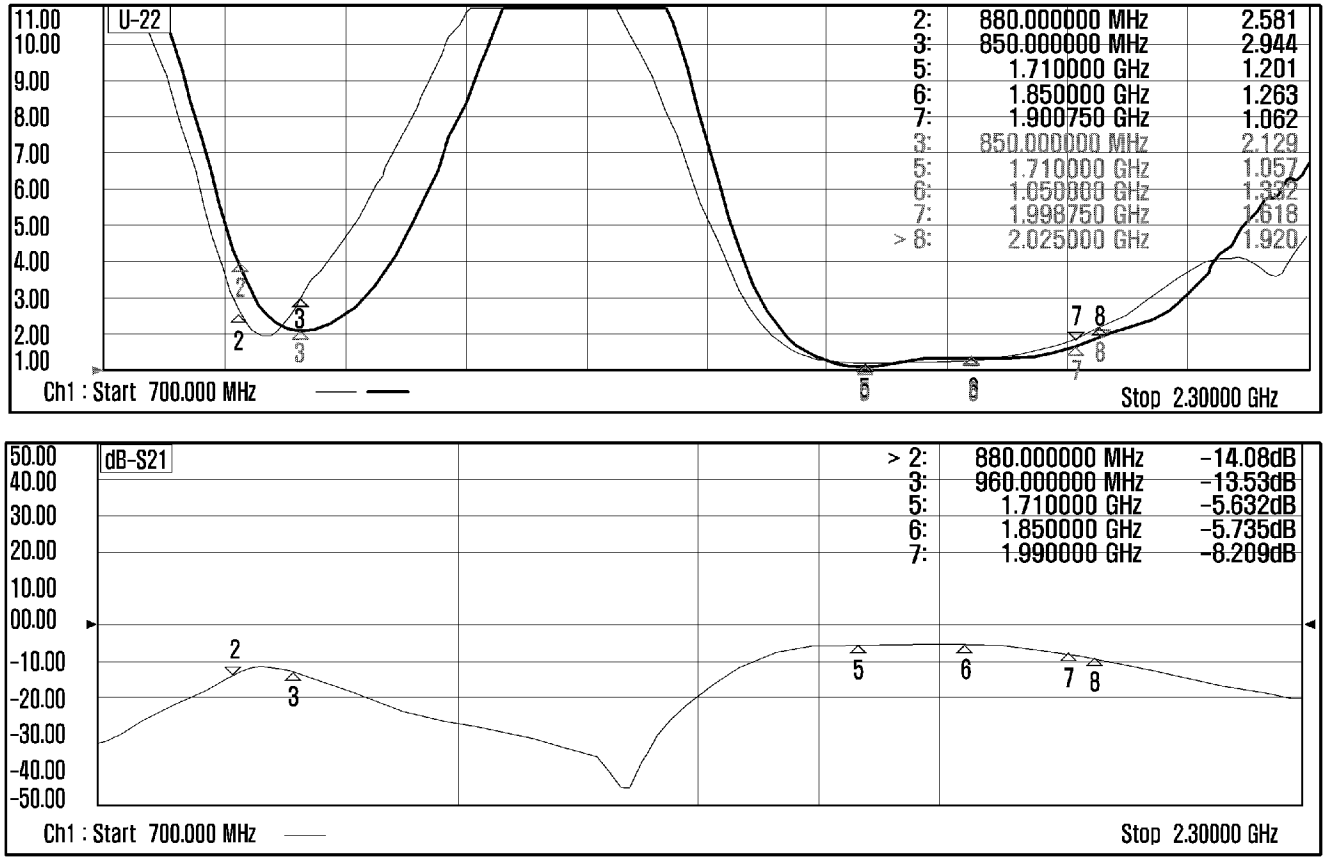
FIG. 5A (RELATED ART)
FIG. 5A is a graph showing measurement results of radiation capacity of an electronic device having an antenna apparatus of the related art.
Figure 5B:
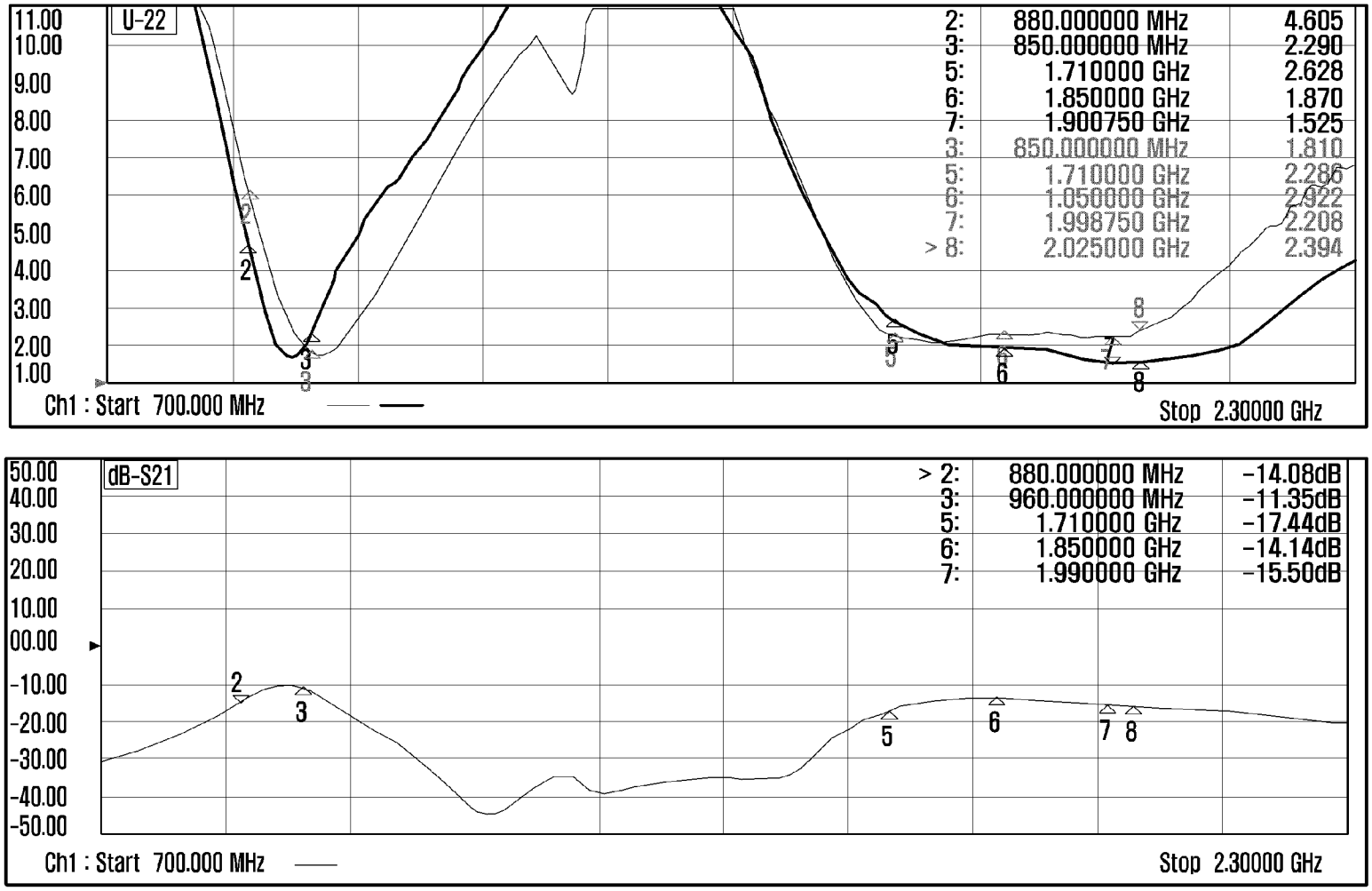
FIG. 5B is a graph showing measurement results of radiation capacity of an electronic device having an antenna apparatus according to the third embodiment of the present disclosure.

FIG. 5A is a graph showing measurement results of radiation capacity of an electronic device having an antenna apparatus of the related art, and FIG. 5B is a graph showing measurement results of radiation capacity of an antenna apparatus according to the third embodiment of the present disclosure.

Table 1 is a comparison of isolations between an antenna apparatus of the related art and an antenna apparatus according to an embodiment of the present disclosure with reference to FIGS. 5A and 5B.

TABLE 1

| Frequency | S21(dB) of an antenna apparatus of the related art | S21(dB) of an antenna apparatus of the present disclosure |
|---|---|---|
| 880 MHz | −14.08 | −14.8 |
| 960 MHz | −13.53 | −11.35 |
| 1710 MHz | −5.632 | −17.44 |
| 1850 MHz | −5.735 | −14.14 |
| 1990 MHz | −8.209 | −15.50 |

Referring to Table 1, when isolations of the antenna apparatus of the present disclosure are compared with those of the antenna apparatuses of the related art, it is noted that the isolation of the antenna apparatus of the present disclosure is reduced by about 0.7 dB (=−14.8−(−14.08)) at a frequency of 880 Mhz, is increased by about 2.2 dB (=−11.35−(−13.53)) at a frequency of 960 MHz, is reduced by about 8.4 dB (=−14.14−(−5.735)) at a frequency of 1850 MHz, is reduced by about 11.1 dB (=−17.44−(−5.632)) at a frequency of 1710 MHz, and is reduced by about 7.2 dB (=−15.50−(−8.209)) at a frequency of 1990 MHz. In brief, it is noted that, in comparison with those of the antenna apparatus of the related art, the isolation values of the antenna apparatus according to the present disclosure are reduced by about 7 to 11 dB at the frequency band of about 1.7 GHz to 2 GHz, which implies that isolation between a first antenna and a second antenna has been improved at the frequency band of about 1.7 GHz to about 2 GHz. Meanwhile, the difference between isolation values (S21) is not large between frequency bands 880 MHz to 960 MHz. This is because the antenna apparatus of the related art has a sufficient isolation value of about −14 dB at the frequency of 880 MHz and 960 MHz.

Moreover, when isolation values of S11 and S22 shown in FIGS. 5A and 5A are compared with each other, it is noted that they are similar to each other. Accordingly, it is noted that, even when the first antenna and the second antenna have separated the commonly used ground unit by means of a slot, such a separation does not largely affect the radiation capacity of the antenna apparatus.

Thus, according to an antenna apparatus of an embodiment of the present disclosure, it is possible to improve isolation between two antennas to thereby improve the radiation capacity.

Here, embodiments of an antenna apparatus and an electronic device having the same according to the present disclosure have been described in conjunction with the appended drawings. In this regard, while some specific terms have been used, they are used in a general meaning to easily explain and to assist in an understanding of the technical contents of the present disclosure, and they are not intended to limit the present disclosure to the disclosed embodiments. In other words, it can be easily understood by those skilled in the art that various embodiments can be made based on the technical idea of the present disclosure without departing from the scope of the present disclosure.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An antenna apparatus comprising:

a plurality of antennas; and a printed circuit board connected to the plurality of antennas, wherein the printed circuit board comprises a plurality of feeding units respectively connected to the plurality of antennas and a plurality of ground units respectively connected to the plurality of antennas, and wherein each of the ground units is separated from the other ground units by means of at least one slot.

2. The antenna apparatus according to claim 1, further comprising at least one lump element which electrically connects the plurality of ground units.

3. The antenna apparatus according to claim 2, wherein the at least one lump element is a capacitor.

4. The antenna apparatus according to claim 2, wherein the at least one lump element is one of a resistor and an inductor.

5. The antenna apparatus according to claim 1, wherein the plurality of antennas are Multiple Input Multiple Output (MIMO) antennas.

6. The antenna apparatus according to claim 1, wherein the plurality of antennas comprise at least two antennas selected from a mobile communication antenna for cellular communication, a Bluetooth antenna, a wireless Local Area Network (LAN) antenna, and a Global Positioning System (GPS) antenna.

7. The antenna apparatus according to claim 1, wherein the at least one slot separates the plurality of ground units of the printed circuit board so that each of the plural antennas is provided with completely electrically separated ground units.

8. The antenna apparatus according to claim 1, wherein the plurality of feeding units are located at a pill-cut region of the printed circuit board.

9. The antenna apparatus according to claim 1, wherein the at least one slot comprises a plurality of slots and wherein each of the ground units is separated from the other ground units by means of at least one of the plurality of slots.

10. The antenna apparatus according to claim 1, wherein the plurality of antennas are located adjacent to each other.

11. An electronic device comprising:

a plurality of antennas;

a plurality of feeding units formed on a printed circuit board and respectively connected to the plurality of antennas;

a ground plane formed on the printed circuit board; and a plurality of floating ground planes that are formed by at least one slot that electrically separates each of the floating ground planes and the ground plane.

12. The electronic device according to claim 11, wherein the printed circuit board further comprises at least one circuit element that electrically connects the plurality of floating ground planes and the ground plane.

13. The electronic device according to claim 12, wherein the at least one circuit element comprises one of a capacitor, a resistor, and an inductor.

14. The electronic device according to claim 12, wherein the plurality of antennas comprise a first antenna and a second antenna, and wherein the at least one circuit element is configured to isolate radiation of signals between the first antenna and the second antenna.

15. The electronic device according to claim 12, wherein the plurality of floating ground planes comprises a first floating ground plane and a second floating ground plane, wherein the at least one circuit element comprises a first circuit element and a second circuit element, wherein the first floating ground plane is coupled to the ground plane via the first circuit element, and wherein the second floating ground plane is coupled to the ground plane via the second circuit element.

16. The electronic device according to claim 15, wherein the plurality of floating ground planes further comprises a third floating ground plane, wherein the at least one circuit element further comprises a third circuit element and a fourth circuit element, wherein the third floating ground plane is coupled to the first floating ground plane via the third circuit element, and wherein the third floating ground plane is coupled to the second floating ground plane via the fourth circuit element.

17. The electronic device according to claim 11, wherein the plurality of feeding units are located at a pill-cut region of the printed circuit board.

18. The electronic device according to claim 11, wherein the at least one slot separates the plurality of floating ground planes so that each of the plural antennas is provided with completely electrically separated ground planes.

19. The electronic device according to claim 11, wherein the at least one slot comprises a first slot and a second slot, wherein the first slot separates the ground plane from each of the floating ground planes, and wherein the second slot separates each of the floating ground planes.

20. The electronic device according to claim 11, wherein the plurality of antennas are located adjacent to each other.

21. An electronic device comprising:

a plurality of antennas located adjacent to each other;

a plurality of feeding units, each of which is connected to the plurality of antennas and is formed on a printed circuit board;

a plurality of ground units, each of which is connected to the plurality of antennas; and at least one capacitor which electrically connects the plurality of ground units, wherein the plurality of ground units are formed by separating a ground unit of the printed circuit board by means of at least one slot.

* * * * *